US005619868A

United States Patent [19]

Schmoll et al.

[11] Patent Number: 5,619,868

[45] Date of Patent: Apr. 15, 1997

[54] SPRINGBEARD NEEDLE

[75] Inventors: Wolfgang Schmoll, Haigerloch-Owingen; Siegfried Wissmann, Albstadt-Pfeffingen, both of Germany

[73] Assignee: Theodor Groz & Söhne & Ernst Beckert, Albstadt, Germany

[21] Appl. No.: 645,336

[22] Filed: May 13, 1996

[30] Foreign Application Priority Data

May 13, 1995 [DE] Germany ..... 195 17 602

[51] Int. Cl.[6] ..... D04B 35/08

[52] U.S. Cl. ..... 66/119

[58] Field of Search ..... 66/85 A, 85 R, 66/119

[56] References Cited

U.S. PATENT DOCUMENTS 2,038,493 4/1936 Jones ..... 66/119 X

FOREIGN PATENT DOCUMENTS 29378 7/1964 Germany ..... 66/119

2521910 12/1975 Germany .

147557 4/1981 Germany ..... 66/119

OTHER PUBLICATIONS

Otto Both, "Die Bandweberei" (Ribbon Weaving), Handbuch der gesamten Textilindustrie, 5th Edition, 1928, pp. 144–149.

*Primary Examiner*—John J. Calvert

*Attorney, Agent, or Firm*—Spencer & Frank

[57] ABSTRACT

A springbeard needle includes a shank having opposite ends, an upper edge, a lower edge and two opposite side faces; a head formed at one of the shank ends; a springbeard extending from the head and being oriented towards the upper shank edge; and a groove provided in the shank. The groove extends from the upper shank edge and is open at one of the side faces. An end portion of the springbeard projects into the groove from the upper shank edge. The groove has a longitudinal axis which forms an acute angle with the lower shank edge and which is oriented towards the head as viewed in a direction from the lower shank edge to the upper shank edge.

11 Claims, 2 Drawing Sheets

IIa
IIa
IV
IV

3'
10'
1'
2'

20
4'
3'
5'
15'
VIII
VIII
IX
IX
18'
12'
10'
11'
12'
8'
7'
9'
1'

21'
3'
15'
10'
1'
8'
1'
13'

14'
1'
10'

15'
10'
1'

SPRINGBEARD NEEDLE

CROSS REFERENCE TO RELATED APPLICATION

This application claims the priority of German Application No. 195 17 602 filed May 13, 1995, which is incorporated herein by reference.

BACKGROUND OF THE INVENTION

This invention relates to a springbeard needle for warp knit machines, particularly crochet galloon machines, ribbon weaving machines and similar textile machines which operate with springbeard needles and in which the threads are introduced at an inclined orientation to the needle axis underneath the spring beard. Raschel machines and the like also belong to this group.

Springbeard needles of the above-outlined type have a shank carrying at least one butt and have, at one end, a throat adjoined by a head (which is an arcuately bent portion) continuing in a springbeard. The free end portion of the springbeard adjoins the shank. The shank is normally provided with a groove into which the elastic springbeard resiliently extends with its free end portion during pressing and loop landing as practiced generally in warp knitting. Particularly for use in crochet galloon machines, springbeard needles are known—such as disclosed, for example, in German Offenlegungsschrift (application published without examination) 2,521,910—in which the shank is provided with a recess at its end adjacent the springbeard. The recess which receives the end portion of the springbeard starts from the upper edge of the shank and is open towards one shank side. The springbeard is bent rectangularly relative to the symmetry plane of the springbeard needle in which the springbeard lies so that its end, together with the bottom of the recess, borders a thread-introducing channel which intersects the longitudinal axis of the needle. When such a springbeard needle is used, separate pressing devices or the like for the springbeard may be dispensed with. A typical yarn-inserting and loop-forming process is described in the above-noted German Offenlegungsschrift.

Generally similar needles also find application in ribbon weaving, in needle looms which operate with springbeard needles as discussed for example, in "Die Bandweberei" (Ribbon Weaving) by Otto Both, 5th Edition, published by Max Jänecke Publishing Company.

The manufacture of the above-outlined springbeard needles is relatively expensive and complex because the lateral recess in the shank, extending essentially in the longitudinal direction of the shank, particularly in the region of the upper shank edge, is bordered by wall portions which are critical for a disturbance-free operation of the needle. As a result, the configuration of the recess is complex, requiring a plurality of milling steps. Further, such a recess weakens the shank and thus the stability of the needle shank in resisting lateral loop tensions is adversely affected. It is a further problem with such needles that the sharp edges of the recess may lead to capillary cuts in the yarn.

SUMMARY OF THE INVENTION

It is an object of the invention to provide an improved springbeard needle of the above-outlined type which has improved properties and is simpler to manufacture as compared to conventional needles.

This object and others to become apparent as the specification progresses, are accomplished by the invention, according to which, briefly stated, the springbeard needle includes a shank having opposite ends, an upper edge, a lower edge and two opposite side faces; a head formed at one of the shank ends; a springbeard extending from the head and being oriented towards the upper shank edge; and a groove provided in the shank. The groove extends from the upper shank edge and is open at one of the side faces. An end portion of the springbeard projects into the groove from the upper shank edge. The groove has a longitudinal axis which forms an acute angle with the lower shank edge and which is oriented towards the head as viewed in a direction from the lower shank edge to the upper shank edge.

The groove according to the invention advantageously extends from the upper shank edge to the lower shank edge and is oriented at least approximately in the direction of yarn feed. Tests have shown that such an arrangement of the groove effects an approximately positive insertion of the yarn so that the yarn is guided in a highly satisfactory manner underneath the springbeard. The groove which is relatively narrow as compared to the known needle recess will cause only a slight weakening of the shank so that the springbeard needle remains stable against lateral loop tensions as well.

The groove structured according to the invention may be provided in the needle shank with a single milling step; sharp edges which may result in the cutting of capillaries in the yarn may thus be avoided without substantial technological outlay or may be removed in the course of the usual finishing processes.

The groove according to the invention ensures, with a high operational safety, the introduction of the yarn underneath the springbeard so that risks of defects in the product are reduced to a minimum while, at the same time, the position of the springbeard relative to the shank is less critical than in prior art structures. Further, the springbeard of the springbeard needles according to the invention may have a very short length which has not been feasible in springbeard needles having the conventional recesses.

The acute angle which the groove axis forms with the lower shank edge is expediently between approximately 10° and 60°. The actual magnitude of such an angle is determined dependent upon the properties of the textile machine in which the needle is used. While generally the groove has throughout parallel flanks, in principle embodiments are feasible in which the groove flares towards the upper and/or lower shank edge in a funnel-shaped manner. Advantageously, the groove has a cross-sectional outline which has the shape substantially of a partial circle which, together with a flat end zone of the springbeard facilitates the introduction of the advanced yarn underneath the springbeard. It will be understood that dependent upon the type and dimensions of the yarns as well as taking into account the particular properties of the textile machine, other shapes for the groove cross section may be provided.

Between the groove and the head a shank region may be present which has the full thickness of the shank and which contributes to stabilizing the throat and the springbeard. Such a shank region is, as a rule, downwardly chamfered at its upper edge in the direction of the head, forming a transition to the throat. In such a case the groove at least partially opens into the chamfered upper edge region. Particularly advantageous yarn feeding conditions are obtained by providing that the springbeard, with its terminal region extending into the groove, is oriented substantially parallel to the groove axis and, as a further preferred feature, the springbeard axis lies in the longitudinal symmetry plane of the groove.

DESCRIPTION OF THE PREFERRED EMBODIMENTS

Figures 1, 2, 2A, 3, 4:
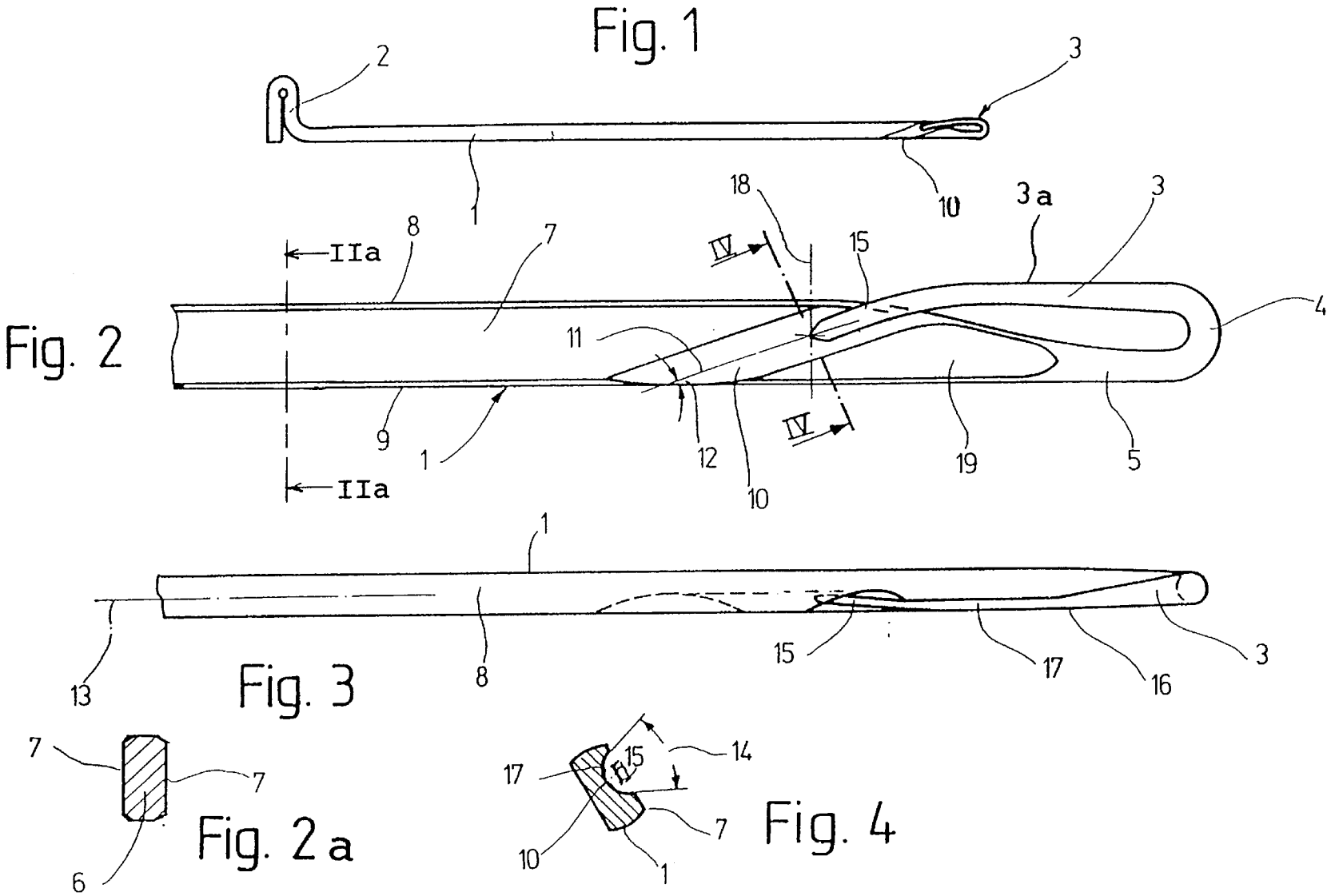
FIG. 1 is a side elevational view of a springbeard needle according to a preferred embodiment of the invention, for use as a crochet galloon needle.
FIG. 2 is an enlarged side elevational view of a detail of FIG. 1.
FIG. 2*a* is a sectional view taken along line IIa—IIa of FIG. 2.
FIG. 3 is a top plan view of the construction shown in FIG. 2.
FIG. 4 is a sectional view taken along line IV—IV of FIG. 2.

The springbeard needle illustrated in FIG. 1–4 is intended for use particularly as a crochet galloon needle. A needle of basically similar construction, however, may be in principle used in warp knitting machines, Raschel machines, circular looms and the like as well as other textile machines.

The springbeard needle of FIGS. 1–4 has a shank 1 which at one end has a formed-on butt 2 and, at its other end, has a throat 5 which continues in a crimping or head 4. A springbeard 3 extends from the head 4 and, with an end portion 15, rejoins the shank 1. The shank 1 is bent from steel wire and is flattened bilaterally so that, as shown in FIG. 2*a*, it has a flat cross-sectional outline of generally rectangular configuration 6 having two opposite parallel large side faces 7. The needle may also be stamped from ribbon steel.

In the shank 1, in the region of the springbeard 3, an inclined groove 10 is provided which extends from the upper shank edge 8 to the lower shank edge 9. As viewed from the lower shank edge 9, the groove 10 is inclined towards the head 4. The longitudinal axis 11 of the groove 10 and the lower shank edge 9 together form an acute angle 12 which is about 20° in the illustrated embodiment. The magnitude of the angle 12 is determined based on properties of the textile machine in which the springbeard needle is utilized. It has been found in practice that, as a rule, the angle 12 is between 10° and 60°.

The groove 10 is open along one of the large side faces 7 oriented toward the observer of FIG. 2. The cross section of the groove 10 has the approximate configuration of a partial circle. As shown in FIG. 3, the depth of the groove 10 reaches approximately to the longitudinal symmetry plane 13 of the shank 1. The groove 10 opens towards the side wall 7 at an angle 14 of approximately 45° in a funnel-like manner.

The end portion 15 of the springbeard 3 is bent towards the shank 1 and projects into the groove 10 in an orientation which is substantially parallel to the longitudinal axis 11 of the groove 10. The end portion 15 is, as may be observed in FIGS. 3 and 4, of flat shape having an essentially rectangular cross-sectional configuration and its terminus is situated at a small distance from the bottom of the groove 10.

With particular reference to FIG. 3, the springbeard 3, as viewed from the head 4, tapers towards one side of the shank 1 to a location 16 which is situated slightly ahead of the mid point of the length of the springbeard 3. From the location 16 the springbeard assumes a narrowed portion 17 which extends laterally of the central longitudinal shank plane 13 and is substantially parallel to the adjoining large side face 7. Thereafter the springbeard continues as the end portion 15 which is inwardly bent toward the central longitudinal shank plane 13. The cross-sectionally rectangular end portion 15 is, in a manner shown in FIG. 4, at an inclined position relative to the bottom of the groove 10 at the deepest location thereof.

The length of the springbeard 7 is so dimensioned that the terminus of the end portion 15 lies in a plane 18 which extends approximately perpendicularly to the upper and lower shank edges 8 and 9. The plane 18 contains that opening edge of the groove 10 in the zone of the upper shank edge 8 which is the remotest from the head 4. The thickness of the end portion 15 of the springbeard 3 is smaller than the width of the groove 10. Such thickness, as it may be observed from FIG. 2, is approximately one-half or less than the groove width in the region of the groove edge, as seen in FIG. 6.

Between the groove 10 and the head 4 a shank portion 19 of full shank thickness is disposed which is essentially of triangular or trapezoidal shape. The shank portion 19 is, at its upper edge, chamfered to slope downwardly towards the head 4 to provide a transition to the throat 5. The groove 10 opens partially into the chamfered upper shank edge region; this arrangement contributes to the stability of the needle.

Figures 5, 6, 7, 8, 9:
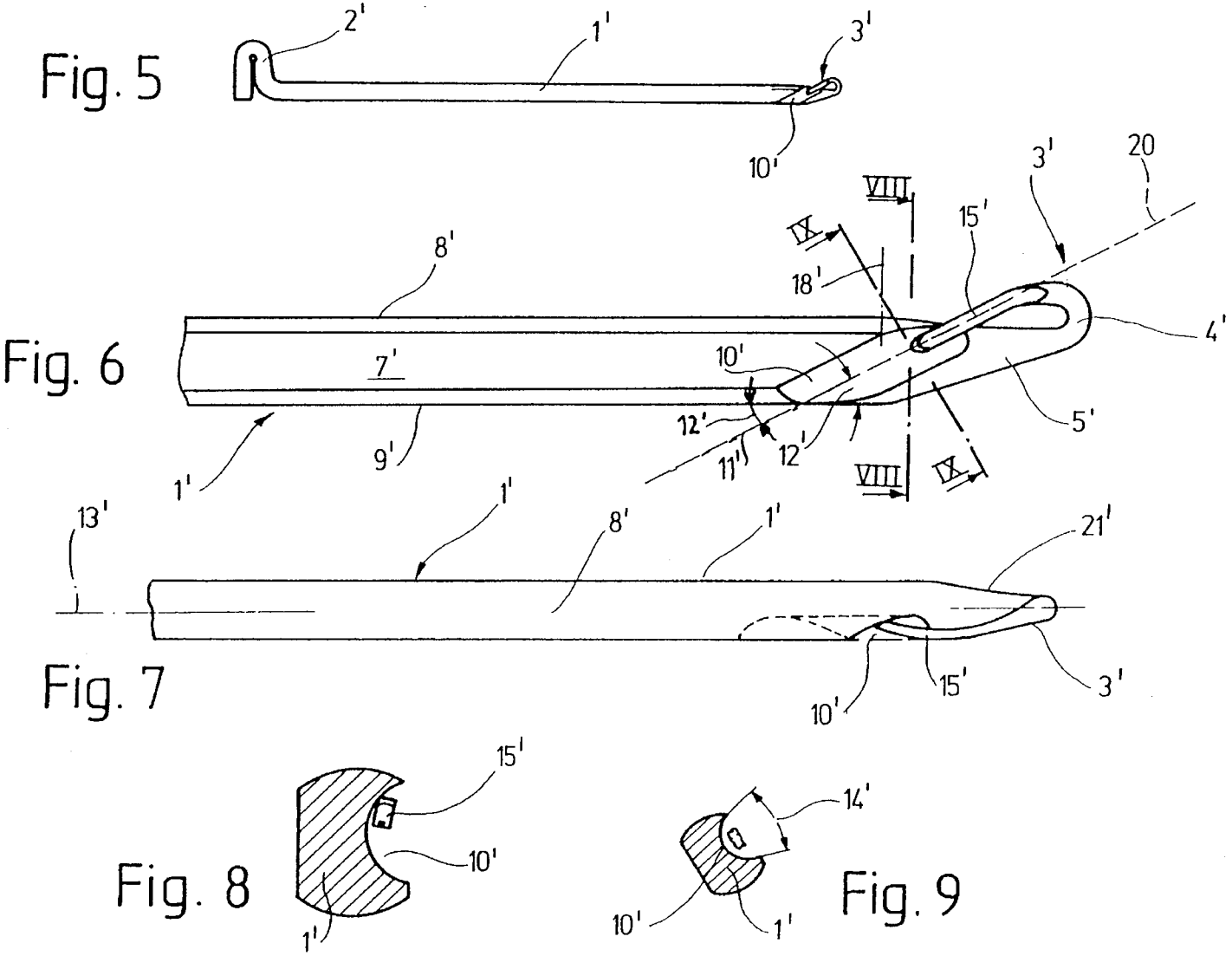
FIG. 5 is a springbeard needle according to another preferred embodiment of the invention, structured as a ribbon weaving needle.
FIG. 6 is an enlarged side elevational detail of the structure shown in FIG. 5.
FIG. 7 is a top plan view of the construction shown in FIG. 5.
FIG. 8 is a sectional view taken along line VIII—VIII of FIG. 6.
FIG. 9 is a sectional view taken along line IX—IX of FIG. 6.

In operation, the yarn designated at 20 in FIG. 6 is placed into the groove 10 which is oriented at least approximately in the direction of yarn feed. Thereafter, it is introduced underneath the springbeard 3 which elastically slightly yields laterally to the necessary extent. The upper edge 3*a* of the springbeard 3 and the upper edge 8 of the shank 1 form a continuous edge which readily allows the yarn, situated underneath the springbeard 3, to be pulled through the previously prepared loop, as it is required in the loop forming process. Since the terminal portion 15 of the springbeard 3 is narrower than the groove 10 and is arranged substantially parallel to the latter, it borders, together with the adjoining groove edge, a yarn-guiding or yarn-introducing groove through which the yarn is securely guided underneath the springbeard 3.

The peripheral edges of the groove 10 are rounded or chamfered particularly also in the merging region at the upper and lower shank edges 8, 9 as well as in the lateral cheek zones.

The springbeard needle illustrated in FIGS. 5–9 is a ribbon weaving needle used in ribbon weaving. It corresponds in its basic construction to the springbeard needle described in detail in FIGS. 1–4. Identical components are designated with the same reference numeral but are provided with a prime sign (') for differentiation.

In the ribbon weaving needle shown in FIGS. 5–9 the groove 10' is of steeper orientation than in the springbeard needle according to the embodiment described in connection with FIGS. 1–4. The acute angle 12' is approximately 30° . In addition, the springbeard 3' is significantly smaller and, as seen in FIG. 6, it is bent essentially arcuately inwardly from the head 4'. As in the first described embodiment, the springbeard 3' is situated laterally adjacent the longitudinal central plane 13' of the shank 1'. The opening angle 14' of the groove 10' is 45° in the region at the end 18' of the springbeard 3'. Because of the more pronounced chamfer of the shank 1', however, the groove 10' has in this region a lesser opening width than in the deeper-lying zones.

The terminus of the springbeard 3', in contrast to the first-described embodiment, stops short of the plane 18' which contains that point of the opening edge of the groove 10' which is remotest from the head 4', so that a clearance between the tip of the springbeard 3' and the plane 18' is obtained.

Because of the shortening of the springbeard 3' the groove 10' is, at its side oriented towards the head 4' not bordered by a region which would correspond to the region 19 of the structure shown in FIG. 2 and which has a full shank thickness. The peripheral edge of the groove 10' lies in a shank region 21' which tapers towards the head 4'.

It is further added that embodiments are feasible in which the groove 10 or 10', starting from the upper shank side does not extend entirely to the lower shank edge 9 or 9'. Also, it may be so designed that it is open in a funnel-shaped manner at one of its ends.

It will be understood that the above description of the present invention is susceptible to various modifications, changes and adaptations, and the same are intended to be comprehended within the meaning and range of equivalents of the appended claims.

What is claimed is:

1. A springbeard needle comprising (a) a shank having opposite ends, an upper edge, a lower edge and two opposite side faces;

(b) a head formed at one of said ends;

(c) a springbeard extending from said head and being oriented towards said upper edge; said springbeard having a free end portion; and (d) a groove provided in said shank; said groove extending from said upper edge and being open at one of said side faces; said end portion of said springbeard projecting into said groove from said upper edge of said shank; said groove having a longitudinal axis forming an acute angle with said lower edge of said shank and being oriented towards said head as viewed in a direction from said lower edge to said upper edge.

2. The springbeard needle as defined in claim 1, wherein said groove is throughgoing from said upper edge to said lower edge.

3. The springbeard needle as defined in claim 1, wherein said longitudinal axis of said groove is oriented at least approximately parallel to a yarn feed.

4. The springbeard needle as defined in claim 1, wherein said acute angle is approximately between 10° and 60° .

5. The springbeard needle as defined in claim 1, wherein said groove has parallel flanks.

6. The springbeard needle as defined in claim 1, wherein said groove has a cross-sectional outline shaped approximately as a partial circle.

7. The springbeard needle as defined in claim 1, wherein said shank has a longitudinal central plane oriented parallel to said side faces; said springbeard extending laterally adjacent said longitudinal central plane; said end portion being angularly bent toward said longitudinal central plane.

8. The springbeard needle as defined in claim 1, wherein said shank has a longitudinal central plane oriented parallel to said side faces; said springbeard extending laterally adjacent said longitudinal central plane; said end portion being arcuately bent toward said longitudinal central plane.

9. The springbeard needle as defined in claim 1, wherein said groove has a width at least twice a thickness of a part of said end portion received in said groove.

10. The springbeard needle as defined in claim 1, wherein said end portion of said springbeard has a longitudinal axis extending parallel to said longitudinal axis of said groove.

11. The springbeard needle as defined in claim 1, wherein said groove has a longitudinal symmetry plane containing said longitudinal axis of said end portion of said springbeard.

* * * * *